United States Patent [19]

Sohner et al.

[11] 4,217,874

[45] Aug. 19, 1980

[54] IGNITION SYSTEM USING A WIEGAND WIRE

[75] Inventors: Gerhard Sohner, Remshalden; Walter Ruf, Korntal-Munchingen, both of Fed. Rep. of Germany

[73] Assignee: Robert Bosch GmbH, Stuttgart, Fed. Rep. of Germany

[21] Appl. No.: 919,808

[22] Filed: Jun. 28, 1978

[30] Foreign Application Priority Data

Jul. 12, 1977 [DE] Fed. Rep. of Germany ..... 2731373

[51] Int. Cl.[2] ..... F02P 1/08

[52] U.S. Cl. ..... 123/594; 315/209 SC; 315/209 T

[58] Field of Search ..... 123/148 E; 315/209 T, 315/209 SC

[56] References Cited

U.S. PATENT DOCUMENTS

| | | | |
|---|---|---|---|
| Re. 29,862 | 12/1978 | Roozenbeek et al. | 123/148 E |
| 3,757,754 | 9/1973 | Wiegand | 123/148 E |
| 3,885,534 | 5/1975 | Webster | 123/148 E X |
| 3,937,193 | 2/1976 | Kim | 123/148 E X |
| 3,952,715 | 4/1976 | Van Siclen, Jr. | 315/209 SC X |
| 3,991,730 | 11/1976 | Crall | 123/148 E X |

OTHER PUBLICATIONS

SAE Paper No. 780208, "The Wiegand Effect and Its Automotive Applications", by J. D. Marks and M. J. Sinko, Feb.-Mar. 1978.

"The Wiegand Effect From Echlin", by The Echlin Manufacturing Company.

*Primary Examiner*—Tony M. Argenbright

*Attorney, Agent, or Firm*—Frishauf, Holtz, Goodman & Woodward

[57] ABSTRACT

Changes in the magnetic field around a Wiegand wire created by a magnetic rotor coupled to a shaft of the engine induce a signal in a sensing coil. The signal is applied to an input switch which forms part of a control circuit. The output of the control circuit is connected to an interrupter switch connected in series with an ignition coil such that a spark is created at the secondary of the ignition coil when the interrupter switch opens. The control circuit maintains the interrupter switch in the nonconductive state for a predetermined percentage of the ignition cycle at low engine speeds and for a lesser percentage at high engine speeds so that enough energy can build in the ignition coil prior to the next interruption at the higher speeds.

13 Claims, 7 Drawing Figures

Fig.1
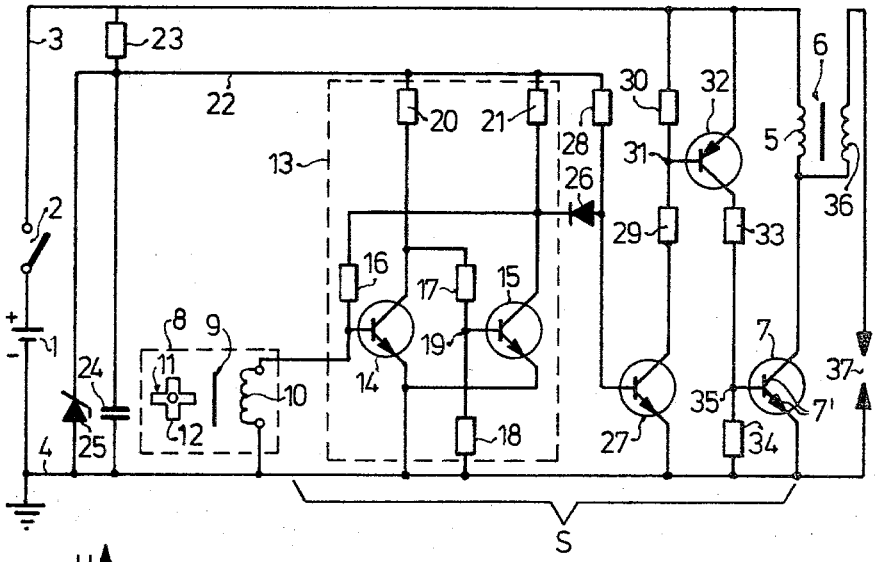
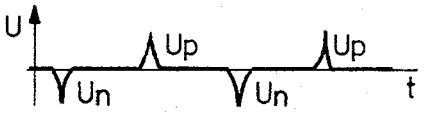
Fig.2
Fig.3
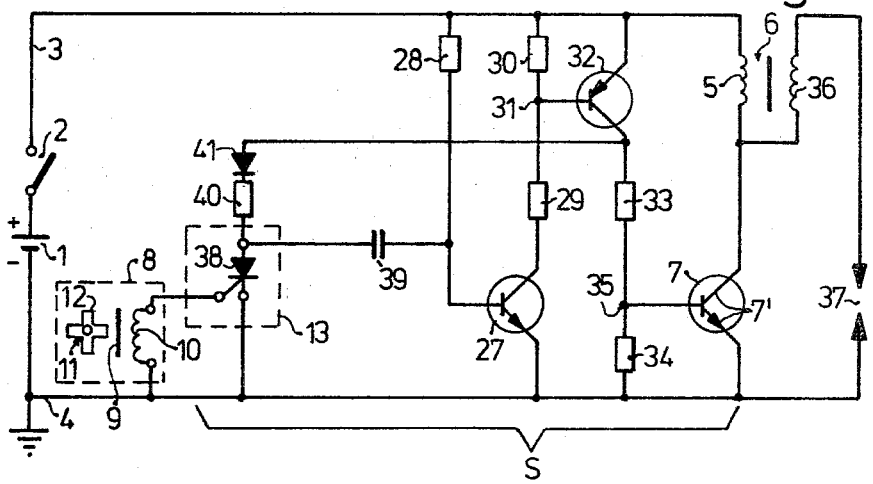

IGNITION SYSTEM USING A WIEGAND WIRE

Cross reference to related application, assigned to the assignee of the present invention:

U.S. Application Ser. No. 868,869, filed Jan. 12, 1978 claiming priority of German application P 27 01 967.6 of Jan. 19, 1977.

The present invention relates to ignition systems and in particular to ignition timing systems wherein the signal initiating the spark is derived from a Wiegand wire.

Background and Prior Art: An ignition system utilizing a Wiegand wire and a coil for receiving the energy radiated by the wire upon a change in the magnetic field surrounding same is disclosed in DT-OS 2,247,511. The operation of this type of wire is described in detail in the magazine Electronics, July 10, 1975, page 100 through 105. In the known ignition system an electronic switch, namely a controllable rectifier, has a control electrode connected via an amplifier to the sensing coil associated with the Wiegand wire, while its anode-cathode circuit is connected between the primary winding of an ignition coil and a storage capacitor. The storage capacitor is connected in shunt with a source of DC voltage. At the ignition time, the anode-cathode circuit of the controllable rectifier is switched to the conductive state allowing the storage capacitor to discharge through the primary winding. This induces a high voltage in the secondary winding of the ignition coil and causes a spark to be generated at the spark plug connected to the secondary winding. This "capacitor type" ignition system is, however, very expensive because the capacitor must be charged through a special power supply since the batteries which are present in the commercial vehicles in which the ignition system is located are insufficient for generating the necessary power. Further, the capacitor type ignition systems furnish only a single burst of energy without any "after-bursts" as is the case for inductive systems. Very lean fuel mixtures are therefore not reliably ignited.

The Invention: In the present invention a magnetic rotor element having a plurality of projections rotates in synchronism with a shaft of the engine and causes an associated Wiegand wire to radiate energy when the projections pass in the vicinity thereof. The signals induced in a coil by the radiated energy are applied to an input switch, preferably a bistable multivibrator or a thyristor. When the input switch changes state, a control circuit causes an interrupter switch connected in series with an ignition coil to be blocked, thereby interrupting the current through the coil and causing a high voltage to be induced in the secondary of the coil. This high voltage breaks down the gap in the spark plug thereby creating the necessary spark. Since the energy is stored in the ignition coil prior to the ignition time, the power supply and storage capacitor are eliminated. The control circuit maintains the interrupter switch in the nonconductive state for a predetermined minimum time interval. At lower speeds, the predetermined minimum time interval is a predetermined percentage of the ignition cycle time. At higher speeds the predetermined percentage of the ignition cycle time is decreased so that enough energy can be stored in the coil prior to ignition even at higher speeds. A Wiegand wire is thus for the first time combined with an induction type ignition system.

Drawing Illustrating a Preferred Embodiment

FIG. 1 is a schematic diagram of a first preferred embodiment of the present invention;

FIG. 2 is a voltage vs. time diagram illustrating the signals induced in the sensing coil of FIG. 1;

FIGS. 3, 4, 5 and 6 are schematic circuit diagrams of variations of the circuit of FIG. 1; and FIGS. *7a–7c* are timing diagrams showing signal variations at a number of circuit points in the circuit of FIG. 6.

Figure 4:
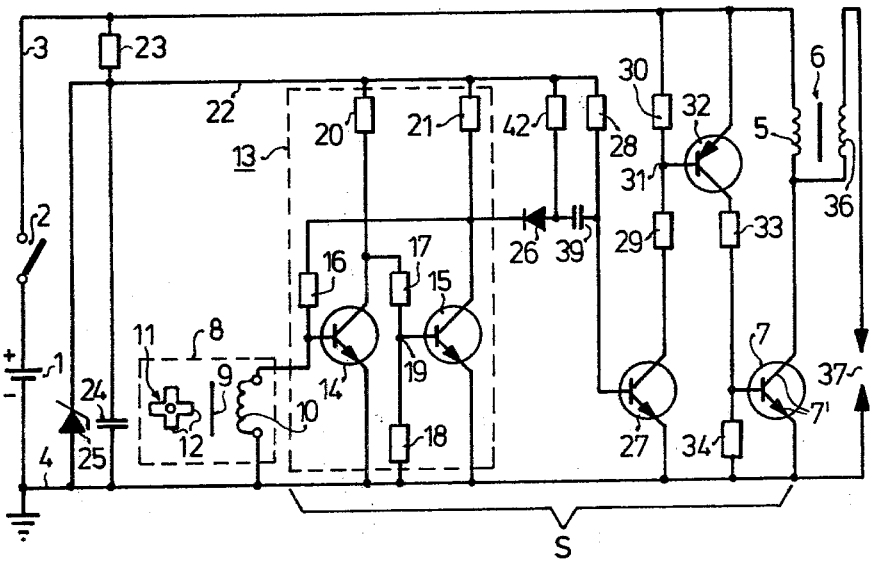

The ignition system shown in FIG. 1 is intended as a system to be used in an internal combustion engine in a motor vehicle. However the present invention is not to be limited to this application or this particular embodiment. The system of FIG. 1 receives energy from a DC source 1, which may be the battery of the motor vehicle. A switch 2 connects a supply line 3 to the positive side of battery 1, while a supply line 4 connected to the negative side of battery 1 is connected to chassis. The primary winding 5 of an ignition coil 6 has one end terminal connected to line 3 and the second end terminal connected to the emitter-collector circuit of a transistor 7 which acts as an interrupter switch. A sensor circuit 8 includes a Wiegand wire 9, a sensing coil 10 and a rotor 11 which is coupled to a shaft of the engine for rotation therewith. Rotor 11 has projections 12 so that the magnetic polarity of wire 9 alternates causing alternately positive and negative control signals ($U_P$, $U_n$) to be induced in coil 10 (see FIG. 2). One end of coil 2 is connected to line 4 while its other end is connected to the control input of input switch means 13. Input switch means 13 include a transistor 14 whose base is connected to the above mentioned end terminal of coil 10. Switch 13 in this embodiment is a bistable multivibrator which also includes a transistor 15 connected in a common emitter circuit with transistor 14. The base of transistor 14 is connected to the collector of transistor 15 through a resistor 16, while the collector of transistor 14 is connected to the base of transistor 15 through a resistor 17. The base of transistor 15 is also connected through a resistor 18 to line 4. The common point of resistor 17 and 18 is denoted by reference numeral 19. The collector of transistor 14 is connected to a line 22 through a resistor 20, while the collector of transistor 15 is connected through a resistor 21 to line 22. Line 22 is connected through a resistor 23 to line 3 and through a capacitor 24 to line 4. The voltage on line 22 is stabilized by a Zener diode 25. The output of the input switching circuit 13 is derived from the collector of transistor 15. This is connected to the cathode of a blocking diode 26 whose anode is connected to the base of a transistor 27. The anode of blocking diode 26 is also connected through a resistor 28 to line 22. The emitter-collector circuit of npn transistor 27 is connected through a resistor 29 and a resistor 30 to line 3. The common point, 31, of resistors 29 and 30 is connected to the base of a transistor 32 which is a pnp transistor. The emitter-collector circuit of transistor 32 is connected to line 3 and, through resistors 33 and 34, to line 4. The common point of resistors 33 and 34 is denoted by reference numeral 35 and is connected to the base of the above mentioned transistor 7. Coil 36, which is the secondary winding of ignition coil 6, has one terminal connected to the collector of transistor 7 and a second terminal connected to a spark plug 37. The other terminal of spark plug 37 is connected to line 4. Switching circuit 13, transistor 27 and transistor 32 with the various associated components together constitute the control circuit.

Operation: As soon as switch 2 is closed the circuit is ready for operation. Let it be assumed that transistor 7 is conductive, that is current flows through primary winding 5 of the ignition coil. Under this condition transistors 32, 27 and 14 also have conductive emitter-collector circuits, while transistor 15 is blocked. When a negative signal $U_n$ appears across coil 10, transistor 14 blocks causing transistor 15 to become conductive. This causes transistors 27, 32 and 7 to be blocked thereby interrupting the current in the primary winding of ignition coil 6 and inducing a high voltage pulse in the secondary winding 36. The nonconductive state of switch 7 is maintained for at least a predetermined minimum time interval so that the spark and in particular the spark tail which is formed by energy discharge following the initial discharge can become fully effective. When the next subsequent positive control signal $U_P$ is created in coil 10, transistor 14 again switches to the conductive state causing transistor 15 to become nonconductive. At this point transistors 27, 32 and 7 again become conductive causing current to flow through the primary winding 5 of ignition coil 6, thereby preparing the system for the next ignition cycle.

The above described circuit allows the control signals furnished by the Wiegand sensor 8 to be useful for controlling inductive type ignition systems in spite of their very narrow (actually needle-like) shape. If necessary, the embodiment shown in FIG. 1 can be modified by substituting a so-called "gate controlled switch" for the bistable multivibrator.

A positive impulse applied to the control electrode of the gate control switch causes the anode-cathode circuit of the switch to become conductive, while a negative impulse applied to its control electrode causes it to be switched to the blocked state. The "potential at the control electrode" is of course a potential of the control electrode relative to the cathode of the gate controlled switch.

In FIG. 3 the input switch 13 is a thyristor 38 whose cathode is connected to line 4 and whose gate is connected to the terminal of coil 10 which is not connected to line 4. The anode of thyristor 38 is connected by a capacitor 39 to the base of transistor 27. It is also connected through a resistor 40 and a diode 41 to the collector of transistor 31. Resistor 23 and line 22 are absent in this embodiment and the base of transistor 27 is connected to line 3 through resistor 28, while its collector is connected by resistors 29 and 30 to line 3. The common point 31 of resistors 29 and 30 is connected to the base of transistor 32. The emitter of transistor 32 is directly connected to line 3, while its collector is connected to line 4 through resistors 33 and 34. The base of transistor 7 is connected to the common point 35 of resistors 33 and 34. The ignition coil 6 and spark plug 37 are connected to transistor 7 as in FIG. 1.

Those elements having the same reference numerals as in FIG. 1 serve the same functions and will not be redescribed with reference to FIG. 3.

Operation: The operation of the circuit of FIG. 3 differs from that of FIG. 1 in that first, only the positive signals $U_P$ are used. When a signal $U_P$ appears across coil 10, thyristor 38 becomes conductive since its anode is connected to line 3 through resistor 40, diode 41 and the emitter-collector circuit of transistor 32 which is in the conductive state. While thyristor 38 was blocked, capacitor 39 charged in a first direction through the conductive emitter-collector circuit of transistor 32, diode 41, resistor 40, and the base-emitter circuit of transistor 27. When thyristor 38 switches to the conductive state, the direction of charge on capacitor 39 reverses, causing a sudden negative voltage to be applied to the base of transistor 27. Transistor 27 blocks as do transistors 31 and 7. The current through the primary winding 5 of ignition coil 6 is thus interrupted, inducing a high voltage across coil 36 and causing a spark to be generated at spark plug 37. As the charge across capacitor 39 increases, the voltage at the base of transistor 27 becomes more and more positive until finally the emitter-collector circuit of transistor 27 again becomes conductive. This causes transistors 32 and 7 to be switched to the condutive state, allowing current to flow through primary winding 5 of ignition coil 6. Energy is thus again stored in the ignition coil for the next ignition process. The circuit is so arranged that, when the direction of charge across capacitor 39 changes, the anode-cathode voltage of thyristor 38 is decreased sufficiently that its anode-cathode circuit also becomes nonconductive. Specifically, the anode-cathode circuit of thyristor 38 becomes nonconductive prior to the time that the emitter-collector circuit of transistor 27 again becomes conductive.

As the speed of the engine increases, the energy stored in capacitor 39 decreases. This decrease in stored energy causes transistor 27 to become conductive sooner when the engine speed increases. Thus the percentage of time that current flows through the primary winding 5 of ignition coil 6 increases with increasing engine speed. The circuit of FIG. 3 is thus a circuit utilizing a Wiegand wire which prevents unnecessary loading of the primary winding of the ignition coil at low engine speeds while still assuring that sufficient energy is stored in the coil prior to the ignition time at high engine speeds.

FIG. 4 shows a system in which the capacitor of storage element 39 of FIG. 3 is incorporated into the circuit of FIG. 1. Specifically, capacitor 39 is connected between the anode of blocking diode 26 and the base of transistor 27. Further, the common point of capacitor 39 and diode 26 is connected through a resistor 42 to line 22.

Operation: When the negative signal $U_n$ appears across coil 10, transistor 14 is blocked and transistor 15 becomes conductive. The direction of charge on capacitor 39 changes, i.e. the charging path includes the now conductive emitter-collector circuit of transistor 15. As a result the base voltage of transistor 27 decreases to such an extent that its emitter-collector circuit is blocked. Therefore the emitter-collector circuits of transistors 32 and 7 are also blocked causing the current in the primary winding 5 of ignition coil 6 to be interrupted. The resulting high voltage induced in secondary winding 36 causes a spark to be generated at spark plug 37. For speeds above a predetermined intermediate speed, the resumption of current flow through primary winding 5 of ignition coil 6 is controlled by capacitor 39. Here too capacitor 39 stores a decreasing amount of energy for increasing engine speeds. Starting with the above mentioned predetermined intermediate speed, the bias voltage at the base of transistor 27 reaches a value allowing the emitter-collector circuit of transistor 27 to become conductive under control of capacitor 39 before the positive sensed signal $U_P$ is furnished by coil 10. Below this speed transistor 27 does not switch back to the conductive state until transistor 15 switches back to the blocked state under control of signal $U_P$. When transistor 15 switches to the blocked state, the charging of capacitor 39 is interrupted and switched again to the opposite direction, that is to the direction prior to the time transistor 15 became conductive. This change and the resulting current through resistor 28 cause transistor 27 to be switched to the conductive state. The emitter-collector circuits of transistors 32 and 7 then also become conductive, again causing current to flow through primary winding 5 of ignition coil 6 thereby storing energy for the next ignition process.

Relative to the simpler arrangement of FIG. 3, the arrangement shown in FIG. 4 has the advantage that even at very low engine speeds current flows through primary winding 5 only for the time required to store the energy for creating an effective spark. Heat losses and wear of the coil are therefore substantially decreased.

Figure 5:
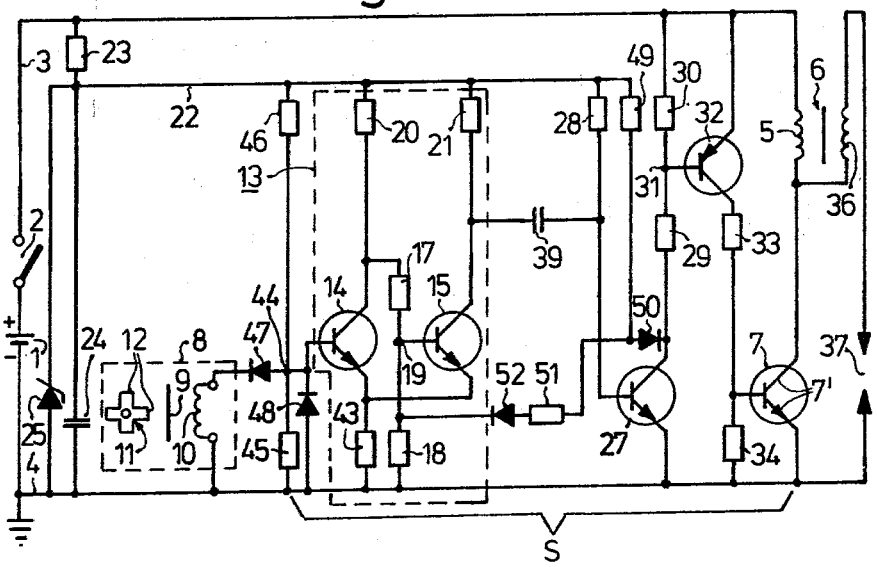

In the system of FIG. 5, the input switch 13 is a Schmitt trigger circuit rather than the bistable multivibrator of FIG. 4. Basically, feedback resistor 16 is omitted and a common emitter resistor 43 is supplied for transistors 14 and 15. This type of circuit utilizing a Schmitt trigger and a capacitor for controlling the time of current flow in the primary winding 5 is particularly advantageous for use in motor vehicles. For this reason, the adaptation of this type of circuit to a sensor using a Wiegand wire is illustrated. Blocking diode 26 and resistor 42 may be omitted in this type of circuit. The base of transistor 14 is generally connected to the common point of a voltage divider including resistors 45 and 46, which is connected between lines 4 and 22. A diode 47 is connected between the base of transistor 14 and one end terminal of sensing coil 10, while a diode 48 is connected between the base of transistor 14 and line 4. Thus only the negative signals $U_n$ will be effective in this arrangment. In order to maintain the blocked condition of transistor 7 for at least a predetermined minimum time interval after signal $U_n$ has ended, a feedback circuit is provided between transistor 27 and input switch 13. This feedback circuit includes a resistor 49 connected to line 22 and to the anode of a blocking diode 50. The cathode of blocking diode 50 is connected to the collector of transistor 27. The anode of blocking diode 50 is further connected through a resistor 51 to the anode of a diode 52. The cathode of diode 52 is connected to the base of transistor 15.

Operation: Diodes 47 and 48 are conductive for signal $U_n$. A voltage drop therefore exists across diode 48 which causes the emitter-collector circuit of transistor 14 to change from the conductive to the nonconductive state. This causes the emitter-collector circuit of transistor 15 to be switched to the conductive state and a resulting change in the charging direction of capacitor 39. As previously mentioned this causes the voltage at the base of transistor 27 to be decreased sufficiently to cause its emitter-collector circuit to become nonconductive. Again, this causes transistors 32 and 7 to be blocked and therefore an interruption of current in the primary winding 5 of ignition coil 6. A spark is thus created at spark plug 37. After signal $U_n$ has died, the emitter-collector circuit of transistor 14 again switches to the conductive state, the threshold value being determined by the ratio of the resistors 45 and 46. However, the emitter-collector circuit of transistor 15 remains in the conductive state for the time during which transistor 27 is blocked. This is caused by current flow through elements 2, 23, 49, 51, 52, 15 and 43. When the emitter-collector circuit of transistor 27 becomes conductive, the voltage at the common point of resistors 51 and 49 drops substantially thereby decreasing the voltage at the base of transistor 15 sufficiently to cause its emitter-collector circuit to be blocked. At this point again a change in charge across capacitor 39 takes place, the capacitor now charging through resistor 21 and the base-emitter circuit of transistor 27. Since transistor 27 is in the conductive state, so are transistors 32 and 7 and current again flows through the primary winding 5 of ignition coil 6.

Figure 6:
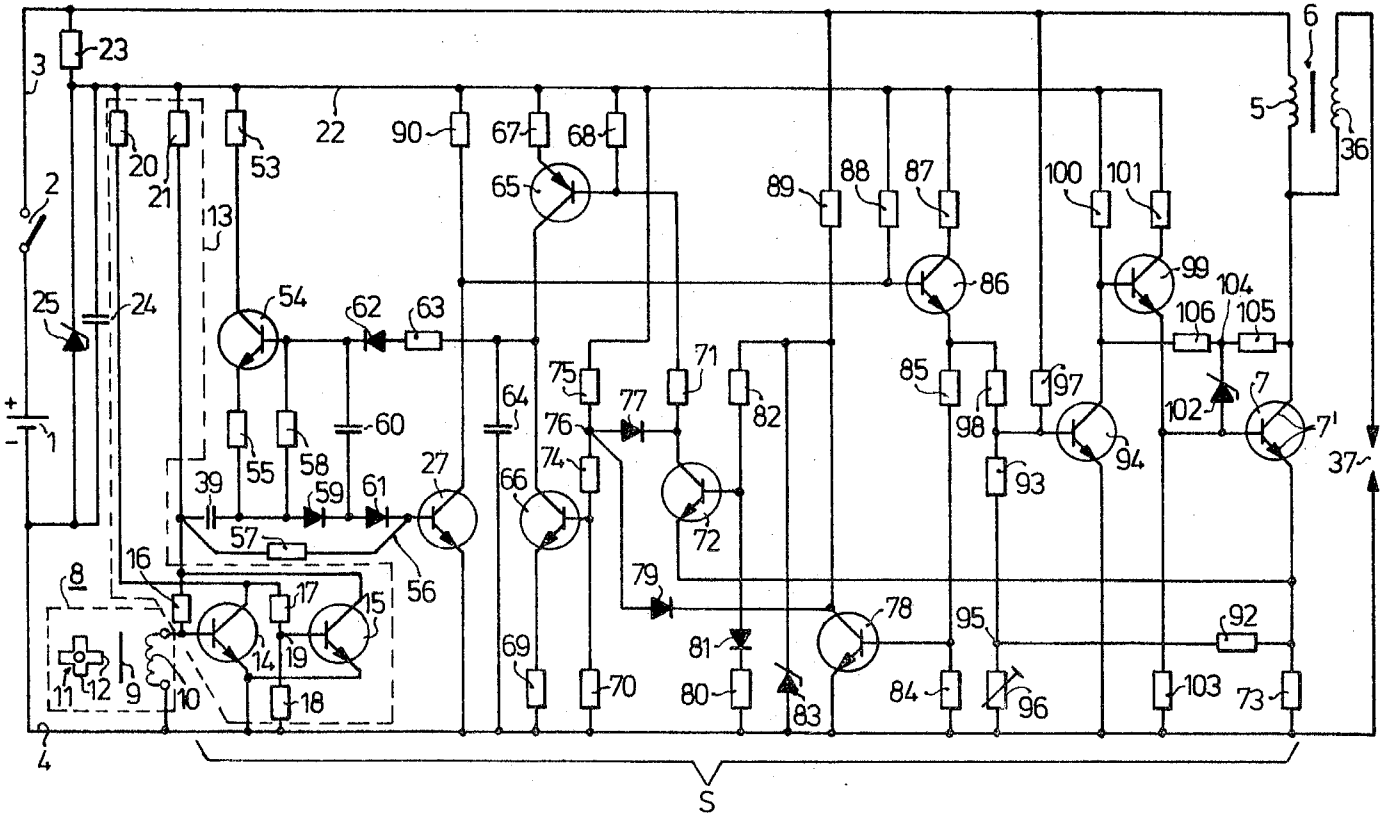

FIG. 6 shows an ignition system in which the current through primary winding 5 is monitored and the ignition energy is metered accordingly. At the input side a sensor 8, an input switch 13 constructed as a bistable multivibrator and a capacitor storage element 39 are connected in approximately the same way as was the case in FIG. 4. In addition, a resistor 53 is connected to line 22 and is also connected to the collector of a transistor 54 whose emitter is connected to one side of capacitor 39 through a resistor 55. The other side of capacitor 39 is connected through the emitter-collector circuit of transistor 15 to line 4. The common point of transistor 15 and capacitor 39 is connected to a circuit branch 56 which includes a resistor 57 connected to the base of transistor 27. The common point of resistor 55 and capacitor 39 is connected through a resistor 58 to the base of transistor 54 and is also connected to the anode of a blocking diode 59 whose cathode is connected through a capacitor 60 to the base of transistor 54. Further, the cathode of diode 59 is connected to the anode of a diode 61 whose cathode is connected to the base of transistor 27. Diode 61 increases the threshold voltage of transistor 27. The base of transistor 54 is connected to the cathode of a blocking diode 62. The anode of blocking diode 62 is connected through a resistor 63 which, with a capacitor 64, forms an integrator circuit. The side of capacitor 64 not connected to resistor 63 is connected to line 4. The common point of resistor 63 and capacitor 64 is connected to the collector of a charging transitor 65 (pnp transistor), whose collector is connected to the collector of the transistor 66. The emitter of transistor 65 is connected through a resistor 67 to line 22. The base of transistor 65 is connected to line 22 through a resistor 68. Transistor 66 forms a discharge path for capacitor 64 and has an emitter connected through a resistor 69 to line 4. Transistor 65 constitutes a constant current source for integrator capacitor 64. The base of transistor 66 is connected to line 4 through a resistor 70. Transistor 66 draws a constant current from integrator 64.

The base of charging transistor 65 is also connected through a resistor 71 to the collector of a transistor 72. The emitter of transistor 72 is connected through a monitoring resistor 73 to line 4 and is also directly connected to the emitter of transistor 7. The base of transistor 66 is connected through a voltage divider including a resistor 74 and a resistor 75 to line 22. The common point 76 of resistor 74, 75 is connected to the anode of a diode 77 whose cathode is connected to the collector of a transistor 72. Point 76 is also connected through a blocking diode 79 to the collector of a transistor 78. The base of transistor 72 is connected to the anode of a diode 81 and to a resistor 82 whose other end terminal is connected to the cathode of a Zener diode 83. The cathode of diode 81 is connected through a resistor 80 to line 4. The cathode of Zener diode 83 is connected to the collector of a transistor 78 and through a resistor 89 to line 3. The emitter of transistor 78 is directly connected to line 4, while its base is connected through a resistor 84 to line 4 and through a resistor 85 to the emitter of transistor 86. Line 22 is connected to the base of transistor 86 through a resistor 88 and to its collector through a resistor 87. The base of transistor 86 is also directly connected to the collector of a transistor 27 whose emitter is directly connected to line 4. Collector of transistor 27 is connected through a resistor 90 to line 22.

Monitoring resistor 73 is shunted by a series circuit including two limiting resistors 92 and 93 and the base-emitter circuit of a transistor 94. The common point 95 of resistors 92, 93 is connected to line 4 through an adjustable resistor 96. The base of transistor 94 is connected through a resistor 97 to line 3 and through a resistor 98 to the emitter of transistor 86. The collector of transistor 94 is connected to the base of an output transistor 99 and through a resistor 100 to line 22. The collector of transistor 99 is connected to line 22 through a resistor 101, while its emitter is connected to the anode of a Zener diode 102 and to the base of transistor 7. The emitter of transistor 99 is also connected through a resistor 103 to line 4. The cathode of Zener diode 102 is connected through a resistor 105 to the collector of transistor 7 and through a resistor 106 to the base of transistor 99.

Figure 7:
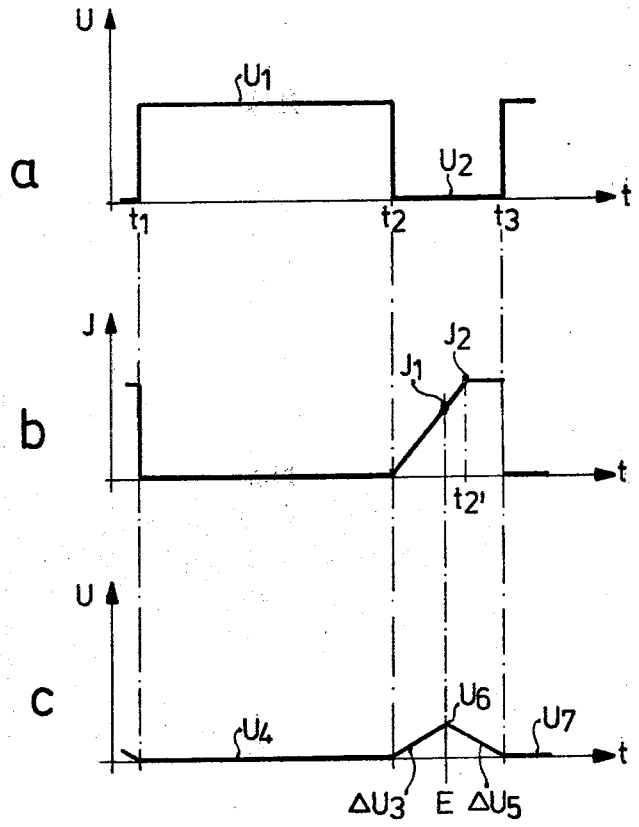

Operation: It is assumed that the internal combustion engine starts up and that the emitter-collector circuit of transistor 14 is conductive while the emitter-collector circuit of transistor 15 is blocked, thereby causing the emitter-collector circuit of transistor 7 to be conductive. A current flows through primary winding 5 of ignition coil 6. If now the negative signal $U_n$ appears across sensing coil 10 the emitter-collector circuit of transistor 14 blocks and that of transistor 15 becomes conductive. While the engine is starting up transistors 54 and capacitor 39 are ineffective so that when transistor 15 switches to the conductive state the voltage across resistor 57 decreases causing transistor 27 to be blocked. The potential at the collector of transistor 27 then switches to the value $U_1$ as shown in FIG. 7*a*. Current can now flow through the base-emitter circuit of transistor 86 and that of transistor 94 so that the emitter-collector circuits of these two transistors become conductive. When transistor 94 becomes conductive, transistor 99 blocks because of the drop of potential at its base. Similarly, transistor 7 blocks causing an interruption of the current through primary winding 5 of the ignition coil 6. The resultant high voltage induced in secondary winding 36 causes a spark to be generated. While the engine is starting up, the flow of primary current resumes when the signal $U_p$ is sensed. The above mentioned transistors then all switch in the opposite direction. Specifically, the emitter-collector circuit of transistor 14 becomes conductive, that of transistor 15 blocks, the emitter-collector circuit of transistor 27 becomes conductive, that of transistor 86 blocks, transistor 94 blocks and the emitter-collector circuits of transistors 99 and 7 become conductive. At this point the voltage at the collector of transistor 27 is the voltage $U_2$ shown in FIG. 7, that is the collector of transistor 27 is substantially at the negative potential of battery 1. The current flow through the primary winding 5 of ignition coil 6 causes energy to be stored for the next ignition process.

Blocking of transistor 86 blocks the base-emitter current of transistor 78 causing its emitter-collector circuit to be blocked. Current can now flow through the base-emitter circuit of transistor 72. This causes the emitter-collector circuit of transistor 72 to become conductive causing current to flow in the emitter-base circuit of transistor 65. The emitter-collector circuit of transistor 65 becomes conductive causing a charge to be built up on integrator capacitor 64. As shown on FIG. 7*c*, the voltage across capacitor 64 at the start of the charging process is a potential $U_4$. The voltage across capacitor 64 during charging changes in accordance with line $\Delta U_3$ in FIG. 7*c*.

FIG. 7*b* shows the variation of current through resistor 73 as a function of time. When this current reaches a value $I_1$, the voltage drop across resistor 73 has increased to such an extent that the emitter-collector circuit of transistor 72 becomes nonconductive. This causes the emitter-collector circuit of transistor 65 to be blocked. This terminates the charging of capacitor 64. The voltage existing across capacitor 64 at this time is denoted by $U_6$ in FIG. 7*c*.

When the emitter-collector circuit of transistor 72 switches to the nonconductive state, base-emitter current flows through transistor 66 and its emitter-collector circuit becomes conductive. Capacitor 64 starts discharge. The discharge potential is shown by line $\Delta U_5$ in FIG. 7*c*. The discharge stops at the ignition time since then the emitter-collector circuits of transistors 86 and 78 become conductive. When transistor 78 becomes conductive transistors 65, 66 and 72 become nonconductive. After the discharge process is terminated the voltage $U_7$ exists across capacitor 64. The amount of charge left on capacitor 64 constitutes the integration value which influences the action of transistor 54. Charging and discharging of capacitor 64 is so-controlled that the changes $\Delta U_3$, $\Delta U_5$ are symmetrical relative to a vertical line drawn through value $U_6$, the change from charge to discharge being fixed by the monitored current $I_1$. As the speed of the engine increases, the integration value, that is the residual voltage left cross capacitor 64 increases since the change of voltage $\Delta U_5$ decreases relative to the change $\Delta U_3$. As the integration value increases, the conductivity of the emitter-collector circuit of transistor 54 increases. Thus at higher speeds when transistor 14 is switched to the non-conductive state by sensed signal $U_n$ and therefore transistor 15 becomes conductive, a first change in the direction of charge across capacitor 39 occurs. Specifically, capacitor 39 will charge through the emitter-collector circuit of transistor 54, and that of transistor 15 thereby effectively blocking the base-emitter current of transistor 27 causing this transistor to become blocked. This, as previously described, causes the emitter-collector circuit of transistor 7 to become nonconductive and an ignition process to be initiated.

Even before sensor 8 furnishes the positive signal $U_p$ causing the emitter-collector circuit of transistor 15 to be blocked again, the first change in charge across capacitor 39 reaches a predetermined threshold value which corresponds to the threshold value of transistor 27. Base-emitter current again flows through transistor 27 causing its emitter-collector circuit to become conductive. In dependence thereon, as described above, the emitter-collector circuit of transistor 7 again becomes conductive and current again flows through primary winding 5. It will be noted that under these conditions the flow of current through primary winding 5 commenced before the positive signal $U_p$ was received and the emitter-collector circuit of transistor 15 was switched to the blocked state. If the positive signal $U_p$ then switches transistor 14 to the conductive state and the emitter-collector circuit of transistor 15 into the nonconductive state, a second change in the charging state of capacitor 39 results. Specifically, capacitor 39 will now charge through resistor 23, resistor 21, diode 59, diode 61 and the base-emitter circuit of transistor 27. During the first change in charge across capacitor 39, an auxiliary capacitor 60 causes additional current to flow through the base-emitter circuit of transistor 54 improving the switching characteristic of this transistor.

Transistor 94 causes the current through primary winding 5 to be limited to a predetermined value $I_2$ which exceeds the monitored value $I_1$. Value $I_2$ is so-chosen that when it is reached a sufficient amount of energy has been stored for the ignition process. When this value is reached, the voltage drop across monitoring resistor 73 as transmitted through resistors 92 and 93 causes transistor 94 to become slightly conductive. The slight conductivity of transistor 94 limits the base-emitter current of transistors 99 and 7 in such a way that the current through the emitter-collector circuit of transistor 7 remains at the value $I_2$.

Zener diode 102 protects transistor 7 from over-voltages, for example during the ignition process.

Circuit elements 80, 81, 82 and 83 cause transistor 72 to operate independently of temperature and variations in the operating voltage.

It is also desirable to allow the current $I_2$ to flow for a time $T_2'$–$T_3$ illustrated in FIG. *7b* before the actual ignition is initiated when the engine is starting up so that sufficient energy for ignition will be stored in primary winding 5 even when the time of current flow is shortened during acceleration of the vehicle in which the engine is situated.

In the embodiments shown in the Figures, the secondary winding 36 is shown as being connected to one spark plug 37 only. Of course coil 36 can be connected in a predetermined sequence with a plurality of spark plugs by means of a conventional distributor.

In a preferred mode of operation, the predetermined minimum time interval for which the nonconductive state of interrupter switch 7 is maintained is Various changes and modifications may be made and are to be included in the scope of the invention.

We claim:

1. In an internal combustion engine having a rotating member, an ignition system comprising sensor means (8) for furnishing a control signal when said rotating member is at a predetermined angular position relative to a reference position, said sensor means having a Wiegand wire adapted to radiate energy in response to a change of magnetic field in the proximity thereof, rotor means (12) coupled to said rotating member for rotation therewith for creating said change in magnetic field when said rotating member has reached said predetermined position, and sensing coil means (10) coupled to said wire for receiving said energy and furnishing said control signal in response thereto, whereby said control signal is a signal having a very short time duration;

ignition coil means (6) for initiation ignition upon interruption of current therethrough;

interrupter switch means (7) connected to said ignition coil means for switching from a conductive to a nonconductive state in response to said control signal, thereby interrupting said current through said ignition coil means; and control circuit means (S) interconnected between said sensor means and said interrupter switch means for maintaining said interrupter switch means in said nonconductive state for at least a predetermined minimum time interval following receipt of said control signal, said control circuit means comprising input switch means (13; 14) having a first and second stable state and adapted to switch from said first to said second stable state in response to said control signal and to remain in said second stable state independently of the absence of said control signal, and further circuit means (15; 39) for switching said input switch means back to said first stable state following said predetermined minimum time interval, said predetermined minimum time interval substantially exceeding said short time duration.

2. A system as set forth in claim 1, wherein said input switch means and said further circuit means constitute a bistable multivibrator (14, 15) adapted to change from said first to said second stable state in response to a first signal of a first polarity and from said second to said first stable state in response to a second signal of a second polarity;

wherein said control signal constitutes said first signal;

wherein said sensor means comprises means for furnishing one of said second signals following each of said first signals;

and wherein said control circuit means further comprises output control means (27, 32) interconnected between said bistable multivibrator and said interrupter switch means for maintaining said interrupter switch means in said nonconductive state while said bistable multivibrator is in said second stable state.

3. A system as set forth in claim 2, wherein said output control means comprises means for maintaining said interrupter switch means in said nonconductive state while said bistable multivibrator is in said second stable state at engine speed less than a predetermined critical engine speed and for maintaining said interrupter switch means in said nonconductive state for a time less than the time said bistable multivibrator is in said second stable state at engine speeds exceeding said predetermined critical engine speed.

4. A system as set forth in claim 3, wherein said output control means comprises a first transistor (27) having a base connected to said bistable multivibrator and an emitter-collector circuit, a second transistor (32) having a base connected to said emitter-collector circuit of said first transistor and an emitter-collector circuit connected to said interrupter switch means in such a manner that said interrupter switch means is in said nonconductive and conductive state respectively when said second transistor is in said nonconductive and conductive state, and a capacitor (39) connected between said base of said first transistor and said bistable multivibrator.

5. A system as set forth in claim 2, wherein said control circuit means comprises means for maintaining said interrupter switch means in said nonconductive state for said predetermined minimum time interval at engine speeds exceeding a predetermined critical engine speed and for maintaining said interrupter switch means in said nonconductive state for a time interval exceeding said predetermined minimum time interval at engine speeds less than said predetermined critical engine speed.

6. A system as set forth in claim 5, wherein said further circuit means comprises a capacitor (39); and wherein said control circuit means further comprises output control means (27, 32) connected to said capacitor, said input switch means and said interrupter switch means for switching said interrupter switch means from said nonconductive to said conductive state and from said conductive to said nonconductive state under control of said input switch means and the charge on said capacitor.

7. A system as set forth in claim 6, wherein said output control means comprises a first transistor (27) having a base and an emitter-collector circuit, a second transistor (32) having a base connected to said emitter-collector circuit of said first transistor and an emitter-collector circuit connected to said interrupter switch means, and connecting means for connecting said capacitor between said input switch means and said base of said first transistor.

8. A system as set forth in claim 7, wherein said connecting means comprises means for connecting said capacitor between said input switch means and said base of said first transistor in such a manner that the direction of charge across said capacitor changes when said input switch means changes from said first to said second stable state.

9. A system as set forth in claim 8, wherein said input switch means comprises a controllable rectifier (38).

10. A system as set forth in claim 9, wherein said controllable rectifier is a thyristor.

11. A system as set forth in claim 8, wherein said input switch means comprises a Schmitt trigger circuit.

12. A system as set forth in claim 6, wherein said output control means comprises integrator means (64) for furnishing an integrator signal varying as a function of the speed of said internal combustion engine, first circuit means (54) connected to said capacitor and said integrator means for charging said capacitor in a first direction at a rate varying as a function of said integrator signal while said interrupter switch means is in said nonconductive state, and additional circuit means connected between said capacitor and said interrupter switch means for switching said interrupter switch means to said conductive state when the charge on said capacitor is a predetermined charge.

13. A system as set forth in claim 12, wherein said first circuit means comprises a rate control transistor having an emitter-collector circuit connected to said capacitor and a base, and means for connecting said base to said integrator means in such a manner that the conductivity of said emitter-collector circuit increases with increasing speeds of said internal combustion engine.

* * * * *